US006277215B1

(12) United States Patent
Adachi et al.

(10) Patent No.: US 6,277,215 B1
(45) Date of Patent: Aug. 21, 2001

(54) STAINLESS STEEL FUR GASKETS

(75) Inventors: Kazuhiko Adachi, Jyoetsu; Kazuyoshi Fujisawa; Kenichi Goshokubo, both of Niigata; Yoshio Yamada, Koshigaya; Yuuichi Kinoshita, Utsunomiya, all of (JP)

(73) Assignees: Sumitomo Metal Industries, Ltd., Osaka; Ishikawa Gasket Co., Ltd., Tokyo, both of (JP)

( * ) Notice: Subject to any disclaimer, the term of this patent is extended or adjusted under 35 U.S.C. 154(b) by 0 days.

(21) Appl. No.: 09/301,337

(22) Filed: Apr. 29, 1999

(30) Foreign Application Priority Data

Oct. 5, 1998 (JP) ..... 10-282758

(51) Int. Cl.[7] ..... C22C 38/18
(52) U.S. Cl. ..... 148/325
(58) Field of Search ..... 148/325

(56) References Cited

U.S. PATENT DOCUMENTS 4,564,566 1/1986 Jerlich et al. .
5,118,576 * 6/1992 Imae et al. ..... 428/408
5,624,504 4/1997 Miyakusu et al. ..... 148/325

FOREIGN PATENT DOCUMENTS

273278 * 7/1988 (EP) ..... 148/325
55-110758 * 8/1980 (JP) ..... 148/325
04210453 7/1992 (JP) .
4191352 7/1992 (JP) .
7-278758 10/1995 (JP) .

* cited by examiner

*Primary Examiner*—Deborah Yee
(74) *Attorney, Agent, or Firm*—Burns, Doane, Swecker & Mathis, LLP

(57) ABSTRACT

Engine gaskets for automobiles are fabricated from an as-quenched stainless steel having a martensitic-ferritic duplex-phase phase structure in which martensite comprises from 40% to 80%. The steel has a composition comprising on a weight basis; C+N: 0.1%–0.3%, Si: not greater than 0.5%, Mn: not greater than 0.7%, Cr: 10%–17%, and Ni: 0–0.6% and a Vickers hardness of from 300 to 500, The steel can be produced by quenching the steel after heating at 850–1000° C.

11 Claims, 3 Drawing Sheets

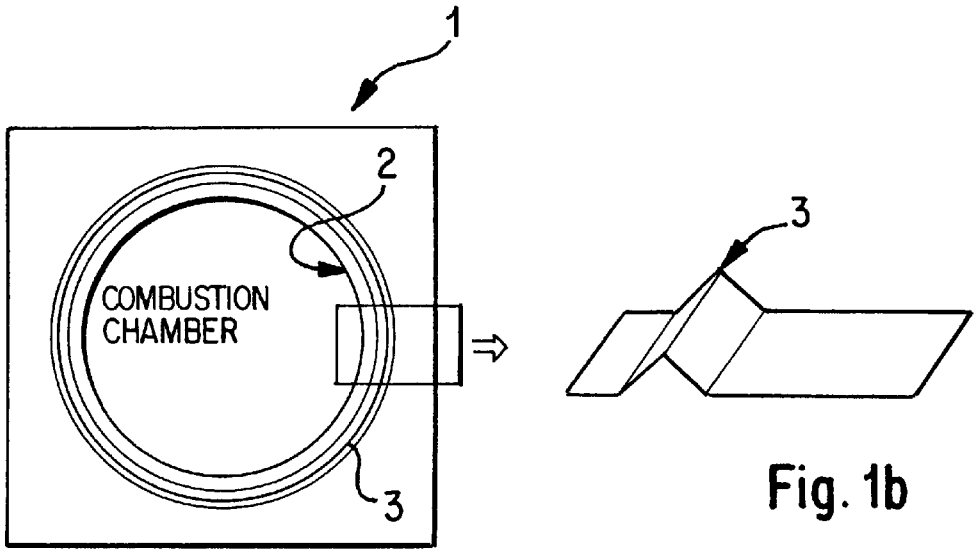
Fig. 1a
Fig. 1b
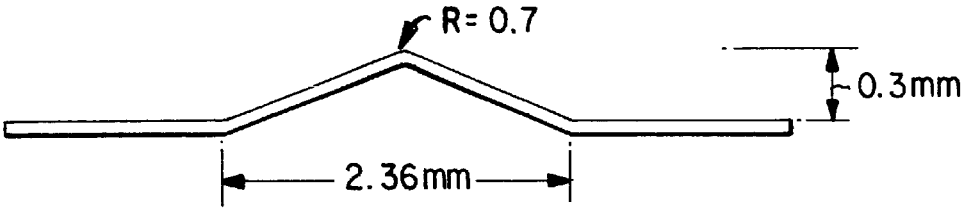
Fig. 2

STAINLESS STEEL FUR GASKETS

TECHNICAL FIELD

The present invention relates to a martensitic-ferritic duplex-phase stainless steel which is inexpensive but has high hardness, good workability, and good corrosion resistance. It also relates to a method for the production of a sheet of such a stainless steel. The stainless steel is particularly suitable for use in the fabrication of engine gaskets for automobiles or the like.

BACKGROUND OF THE INVENTION

Engine gaskets are important parts of automotive engines. The gaskets are positioned between a cylinder head and an engine block which define a combustion chamber of an automotive engine. As shown in FIGS. 1(*a*) and 1(*b*), an engine gasket 1 is a sealing member having an opening 2, which generally has a circular shape with the same diameter as the cylinder of the engine, and an annular bead 3 which is a ridge formed by beading so as to surround the opening. The bead 3 functions as a seal since it is compressed between the cylinder head and engine block and blocks the interstice therebetween to prevent leakage of combustion gas, cooling water, and lubricating oil from the combustion chamber.

A material for fabricating such a gasket is, therefore, required to have high strength (high hardness) sufficient to retain a bead against compression, along with good workability and good corrosion resistance.

In order to meet the above-described requirements, a metastable austenitic stainless steel, such as SUS 301 stainless steel which is a Cr- and Ni-added stainless steel, has been used to fabricate engine gaskets. Deformation of such a steel by cold working, such as cold rolling and beading, causes the metastable austenite in the deformed area to transform to martensite which has a greater hardness. Thus, the steel can exhibit a high work hardenability with good workability.

However, such a stainless steel has the disadvantage that its properties, particularly hardness may fluctuate greatly, since the increased hardness of the steel obtained by working may vary significantly depending on the working ratio of the steel and the temperature at which the steel is subjected to working. Therefore, the quality, particularly sealing quality of gaskets made from the steel may fluctuate significantly. Another disadvantage is that the metastable austenitic steel is susceptible to stress corrosion cracking. Furthermore, the steel contains a large amount of nickel, which is expensive, thereby adding to the production costs of the gaskets.

In order to cope with these problems, a Cr-based martensitic stainless steel having a tempered martensitic structure has been proposed for the fabrication of engine gaskets in Japanese Patent Application Laid-Open No. 7-278758 (1995). In general, martensitic stainless steel has improved resistance to stress corrosion cracking over the above-described metastable austenitic stainless steel. Moreover, it is relatively easy to achieve a high hardness with martensitic stainless steel by means of quenching, which causes transformation to form hard martensitic phases. Furthermore, martensitic steel is less expensive since it contains a very limited amount of expensive Ni.

However, since martensitic stainless steel as quenched has a decreased elongation and is difficult to work, it is essential that the quenched martensitic steel be subjected to heat treatment for tempering after quenching. Such heat treatment adds to the production costs of the steel and may cause embrittlement of the steel due to deposition of carbides or a loss of corrosion resistance due to the formation of Cr-deficient phases resulting from the deposition of carbides.

U.S. Pat. No. 5,624,504 discloses a martensitic-ferritic duplex-phase stainless steel which contains C, Si, Mn, P, S, Ni, Cr, N, B and Cu as essential alloying elements. The fraction of the martensite in the steel structure is selected so as to provide the steel with high strength, and the grain size of the martensite is as small as 10 $\mu$m or less to assure good workability. The steel has a low carbon content of up to 0.10% by weight. This patent does not teach that the steel is suitable for use in the fabrication of gaskets.

Thus, there is a need for a high-performance, less expensive stainless steel for engine gaskets which can be produced in a stable manner.

These and other objects and advantages of the present invention will be apparent from the description as set forth below.

SUMMARY OF THE INVENTION

The present invention provides a less expensive martensitic-ferritic duplex-phase stainless steel suitable for use in the fabrication of engine gaskets, the steel improved in that it can exhibit high strength with good workability and good corrosion resistance as quenched (without tempering), contrary to the above-described martensitic stainless steel.

The present inventors found that when quenching occurs starting from a temperature in the two-phase region of austenite plus ferrite rather than in the higher-temperature, austenitic single-phase region in such a manner that the austenite in the austenitic-ferritic duplex-phase structure is transformed to martensite having high hardness to form a two-phase structure of martensite plus ferrite, the resulting as-quenched martensitic-ferritic duplex-phase steel exhibits good workability which is sufficient to fabricate gaskets, and it still maintains high hardness and good corrosion resistance, provided that the hardness and the fraction of martensite of the steel are within specific ranges.

The present invention provides for a less expensive stainless steel suitable for use in the fabrication of gaskets, with addition of a minimized amount of expensive metals such as nickel.

In one aspect, the present invention relates to a stainless steel suitable for use in the fabrication of gaskets, particularly engine gaskets, which has a chemical composition comprising on a weight basis:

C+N: 0.1%–0.3%,

Si: not greater than 0.5%,

Mn: not greater than 0.7%,

Cr: 10%–17%, and

Ni: 0–0.6%, the steel having a structure consisting essentially of from 40% to 80% by volume of martensite, the balance being ferrite, and a Vickers hardness in the range of from 300 to 500. Preferably, the martensite (martensitic phases) in the steel structure has a Vickers hardness in the range of from 300 to 600.

Preferably, the steel has a chemical composition consisting essentially, on a weight basis, of:

C+N: 0.1%–0.3%,

Si: not greater than 0.5%,

Mn: not greater than 0.7%,

Cr: 10%–17%,

Ni: 0–0.6%, and one or more elements selected from the group consisting of Nb, V and Ti: 0 to 2.0% in total, the balance being iron and inevitable impurities.

In another aspect, the present invention provides a method for producing a stainless steel sheet suitable for use in the fabrication of gaskets, which comprises the steps of:

preparing a steel having the above-described chemical composition, applying working to the steel to form a sheet having a predetermined thickness, and subjecting the steel sheet to final heat treatment at a temperature in the range of from 850° C. to 1000° C. followed by quenching.

The term "steel sheet" used herein encompasses a steel strip, coil, and the like.

In still another aspect, the present invention provides a gasket, particularly engine gasket, having at least one bead, the gasket being made from the above-described stainless steel.

In a broad sense, the present invention relates to a stainless steel gasket having at least one bead for sealing, the stainless steel having an as-quenched martensitic-ferritic duplex-phase structure. More specifically, the present invention provides such a gasket, particularly engine gasket, which is made from a steel having a martensitic-ferritic duplex-phase structure in which martensite comprises from 40% to 80% by volume of the structure, the steel having a Vickers hardness in the range of from 300 to 500. Preferably the martensitic phases in the steel have a Vickers hardness in the range of 300 to 600.

BRIEF DESCRIPTION OF THE DRAWINGS

FIG. 1(*a*) is a schematic plan view of an engine gasket, and FIG. 1(*b*) is an enlarged perspective view of a portion cut out from the engine gasket.

FIG. 2 is a cross-sectional view of a beaded rectangular test piece of an Fe-13 Cr steel sheet to show the shape of a bead.

DETAILED DESCRIPTION OF THE INVENTION

Figure 3:
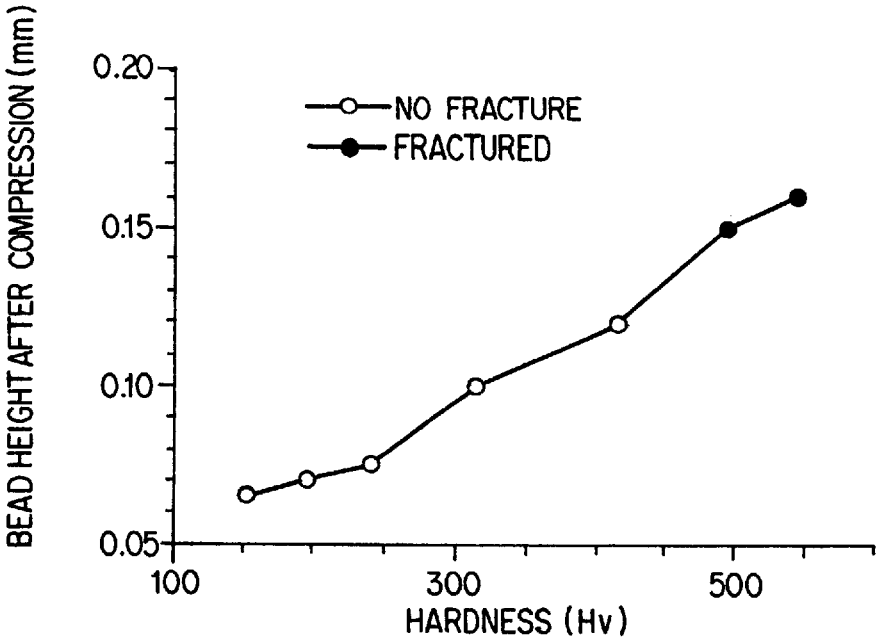
FIG. 3 is a graph showing the effect of hardness of a steel on the bead height after release of a compression force applied to a beaded test piece in such a manner that the test piece is made completely flat.

The stainless steel according to the present invention has a chemical composition comprising on a weight basis:

C+N: 0.1%–0.3%,

Si: not greater than 0.5%,

Mn; not greater than 0.7%,

Cr: 10%–17%, and

Ni: 0 –0.6%, and it is an as-quenched steel having (1) a two-phase structure of martensite plus ferrite in which the fraction of martensite is from 40% to 80% by volume, and (2) a Vickers hardness (Hv) of at least 300 and at most 500. Preferably, the martensite in the two-phase structure has a Vickers hardness of at least 300 and at most 600.

The chemical composition of the stainless steel (which is expressed in weight percent) is selected as described above for the following reasons.

C+N: 0.1%–0.3%

Both carbon (C) and nitrogen (N) allow martensite to harden by addition thereof in a small amount. The effects of these two elements are almost equivalent to each other. If the total content of C+N is less than 0.1%, it may be impossible to obtain a desired hardness of at least Hv 300 by quenching. A total content of C+N in excess of 0.3% makes the steel too hard, thereby adversely affecting its workability, Therefore, the total content of C+N is at least 0.1% and at most 0.3% and preferably at least 0.12% and at most 0.25%.

Preferably, the carbon content is in the range of from 0.10% to 0.20% and more preferably from 0.10 to 0.15%, and the nitrogen content is usually in the range of from 0.02% to 0.09% and particularly from 0.02% to 0.07%.

Si: ≦0.5%

Silicon (Si) also allows martensite to harden. Addition of Si in excess of 0.5% causes the steel to have a deteriorated workability. Therefore, the Si content is not greater than 0.5% and preferably in the range of 0.2% to 0.4%.

Mn: ≦0.7%

Manganese (Mn) serves to extend the austenitic phase region of a steel formed at high temperatures and lower the temperature above which the austenite is stable. As a result, Mn is effective for increasing the fraction of martensite in the duplex-phase structure of the steel formed by quenching. However, addition of more than 0.7% Mn may cause the formation of a steel having a martensitic single-phase structure by quenching, thereby deteriorating the workability of the steel. Addition of an excessively large amount of Mn may cause the formation of a steel in which residual austenite appears after quenching, which makes it impossible to obtain the desired hardness. Therefore, the Mn content is not greater than 0.7% and preferably in the range of 0.25% to 0.5%.

Cr: 10–17%

Chromium (Cr) is an essential element for stainless steel. Addition of at least 10% Cr is generally necessary to assure a stainless steel with effective corrosion resistance. However, the presence of Cr is thought to tend to retard the desired transformation to martensite of the austenite which exists at high temperatures, and addition of more than 17% Cr may cause the formation of a quenched steel having retained austenitic phases, which makes it difficult or impossible to achieve the desired hardness. Therefore, Cr is present in the steel in an amount of from 10% to 17% and preferably from 12% to 15%.

Ni: 0–0.6%

Like Mn, nickel (Ni) also extends the austenitic phase region of a steel appearing at high temperatures, and Ni may optionally be added in an amount of up to 0.6% in order to lower the temperature above which the austenite is stable and increase the fraction of martensite in the duplex-phase structure of the steel formed by quenching. However, addition of more than 0.6% Ni causes the formation of a quenched steel having a martensitic single-phase structure, thereby deteriorating the workability of the steel. Therefore, when added, Ni is present in an amount of not greater than 0.6% and preferably not greater than 0.5%.

The hardness of the duplex-phase stainless steel according to the present invention primarily depends on the hardness and fraction of martensite (martensitic phases) in the steel. As can be suggested from the foregoing, the hardness of the martensite can be tailored primarily by the contents of C, N, and Si, while the fraction of martensite can be tailored primarily by the contents of Cr, Mn, and Ni.

The steel composition may consist essentially of the above described elements with a balance of Fe and inevitable impurities. Other optional elements may be added to the steel. For example, at least one element selected from the group consisting of Nb (niobium), V (vanadium), and Ti (titanium) may be added in a total amount of up to 2.0% in order to improve the strength of the steel.

Figure 4:
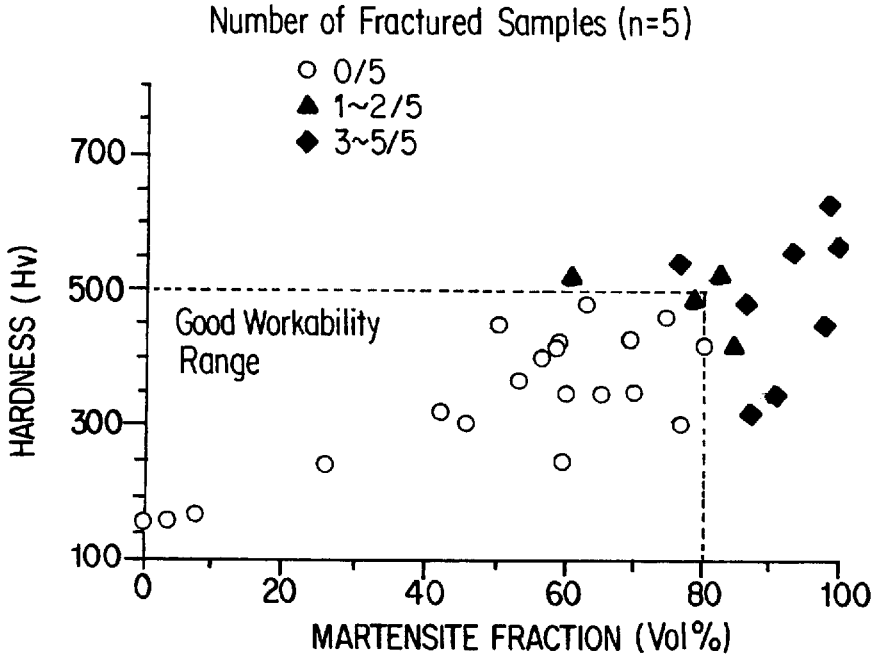
FIG. 4 is a graph showing the effect of fraction of martensite and hardness of a steel on occurrence of fracture during beading.
Figure 5:
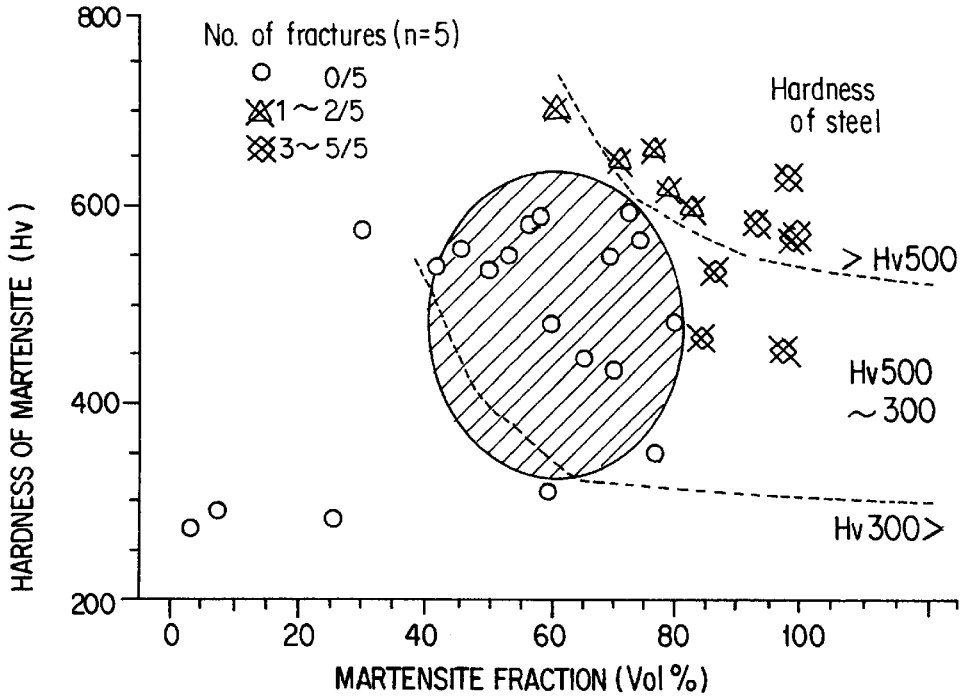
FIG. 5 is a graph showing the effect of fraction and hardness of martensite in a steel on occurrence of fracture during beading.

The reason for defining the martensite fraction and Vickers hardness of the stainless steel or martensite according to the present invention will be described by referring to some experiments, the results of which are shown in FIGS. 3 to 5.

In the experiments, an Fe-13Cr steel having the composition shown in Table 1 below was cast into an ingot, which was subjected to hot rolling and cold rolling to form a sheet having a desired thickness (=0.2 mm in these experiments).

TABLE 1

| C | Si | Mn | P | S | Cr | Ni | Ti | N | V |
|---|---|---|---|---|---|---|---|---|---|
| 0.13 | 0.29 | 0.43 | 0.018 | 0.0009 | 13.0 | 0.29 | 0.12 | 0.06 | 0.08 |

Samples of the resulting steel sheet were finally subjected to quenching after heating at different temperatures to provide the samples with varying values for martensite fraction and hardness (Hv) of the martensite and the steel.

The martensite fraction (in volume percent) of the resulting as-quenched steel was determined by determining the fraction of ferrite in the steel by means of a ferrite meter and subtracting the ferrite fraction (in volume percent) from 100.

The Vickers hardness of the steel was measured by a Vickers hardness tester having a pyramidal diamond indenter in a manner known per se. The Vickers hardness tester was also used to measure the hardness of martensite in the steel in the following manner. A sample steel sheet was polished and then etched to reveal martensitic phases, which could be readily distinguished from ferritic phases. The diamond indenter of the tester was positioned on a martensitic phase of the sample to apply a load which is low enough to leave a small indentation which did not extend beyond that martensitic phase, and the Vickers hardness of martensite was determined from the size of that indentation.

Rectangular test pieces were cut out from each sample steel sheet. Each test piece was deformed by beading on a mold press to form a straight bead which had the cross-sectional shape shown in FIG. 2 and which ran perpendicularly to the longer sides of the rectangle. The beaded test piece was visually observed to determine if any fracture in the deformed area occurred.

The bead of the test piece was then compressed on a compression testing machine until the bead was made completely flat. After the compression force was applied to the test piece for 5 minutes, it was released and the height of the bead was measured.

The results of the bead height after release of the compression force are shown in FIG. 3 as a function of hardness of the test piece (steel). As can be seen from FIG. 3, the bead height, which had been the same value of 0.3 mm for all test pieces prior to compression, was in the range of from 0.06 mm to 0.15 mm after compression.

Test pieces having an Hv value of at least 300 maintained a bead height of 0.10 mm or greater after compression, indicating that they could serve as effective sealing members. Some of test pieces having a value for Hv in excess of 500 were fractured while they were subjected to beading.

FIG. 4 shows the effect of the martensite fraction and hardness of a steel on occurrence of fracture during beading. Although the hardness of a steel tends to increase as the martensite fraction increases, steels having a given martensite fraction gave values for hardness which varied in a relatively wide range. Fracture in the deformed area was frequently observed with those samples having a martensite fraction exceeding 80% by volume or a hardness exceeding Hv 500.

FIG. 5 shows the effect of the martensite fraction and hardness of martensite and that of a steel on occurrence of fracture during beading. As can be seen from this figure, no or little fracture occurred when the martensite had a Vickers hardness of not greater than 600 and the martensite fraction was not greater than 80%. The workability of a martensitic-ferritic duplex-phase stainless steel appears to be influenced by both the hardness of the martensite and the fraction of martensite.

When the fraction of martensite is less than 40% by volume, it is difficult to give a steel having a hardness of at least Hv 300 by quenching.

Based on the test results discussed above, the duplex-phase stainless steel according to the present invention should have a Vickers hardness in the range of from 300 to 500 as the steel and a martensite fraction in the range of from 40% to 80% by volume to provide the steel with good workability while maintaining effective sealing performance. Preferably the martensitic phases of the steel has a Vickers hardness of from 300 to 600.

The martensitic-ferritic duplex-phase stainless steel having the above-described chemical composition, hardness, and martensite fraction can be produced by preparing a steel having the above-described chemical composition, applying working to the steel to give a sheet having a predetermined thickness, and finally subjecting the steel sheet to quenching after heating at a temperature in the range of from 850° C. to 1000° C.

The steel sheet to be subjected to quenching may be a cold rolled steel sheet which usually has a thickness in the range of from 0.1 mm to 0.3 mm.

Figure 6:
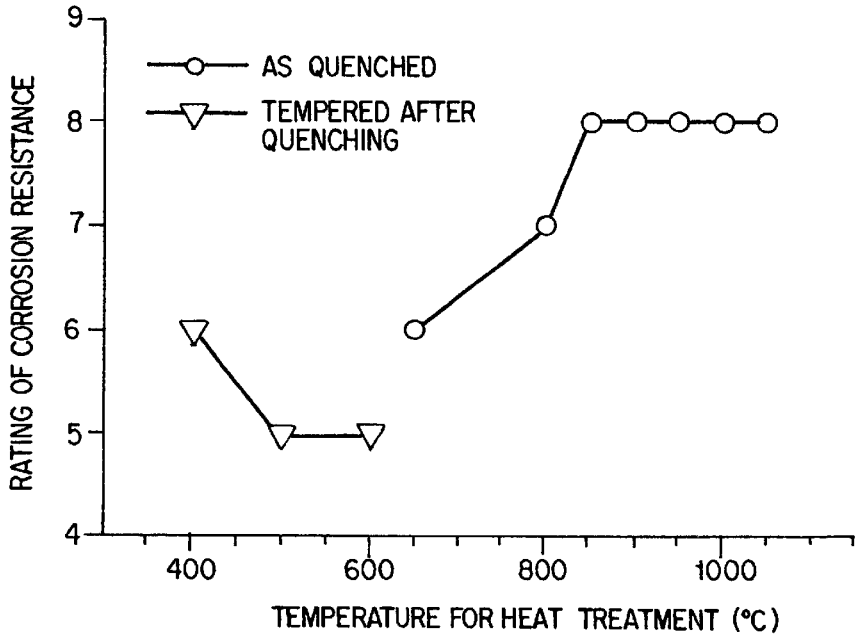
FIG. 6 is a graph showing the effect of temperature of heat treatment on the corrosion resistance of a test piece of an Fe-13Cr steel in a salt spray test (JIS Z-2371).

FIG. 6 shows the effect of heating temperature for quenching on corrosion resistance of steel sheet samples prepared in the manner described above. Namely, the samples were cold-rolled steel sheets which had the chemical composition shown in Table 1 above and which had been quenched after heating at different temperatures. Some of the steel sheet samples which had been quenched after heating at 1000° C. were then subjected to tempering in the temperature range of from 400° C. to 600° C. The corrosion resistance was tested in accordance with the salt spray test specified in the specification JIS Z-2371 and given a rating from 0 (worst) to 10 (best) according to that specification.

As can be seen from FIG. 6, when the heating temperature for quenching was below 800° C., the corrosion resistance became significantly worse. Similarly, the corrosion resistance was significantly deteriorated by subjecting the quenched steel sheet to tempering. This is thought to be attributable to the formation of Cr-deficient phases due to deposition of chromium carbides.

When the heating temperature for quenching exceeds 1000° C., the heating is expected to form an austenitic single-phase structure, which may result in the formation of a quenched structure which comprises more than 80% by volume of martensite, thereby adversely affecting the workability of the quenched steel.

Therefore, the heating temperature for quenching is between 850° C. and 1000° C. The duration of heating is preferably at least 10 seconds and the subsequent quenching is preferably performed at a cooling rate of at least 10° C. per second, although these parameters may vary depending on the steel composition and the heating temperature for quenching.

The present invention can stably provide a less expensive stainless steel which is of high performance sufficient for use in the fabrication of gaskets having at least one bead (ridge formed by beading) for sealing, particularly engine gaskets suitable for use in gasoline engines for automobiles or the like.

The shape of the gaskets is not critical. In general, an engine gasket is rectangular or square in shape and has one or more openings, the number of which corresponds to the number of cylinders in the engine. Each opening is surrounded by at least one bead for sealing, which normally has a semicircular, semielliptic or rectangular cross section rather than a triangular cross section as shown in FIG. 1(*b*). Generally, the height of the bead is in the range of from 0.15 mm to 0.40 mm, while the width thereof is from 1.0 mm to 5.0 mm.

Engine gaskets can be fabricated from the above-described stainless steel sheet in a conventional manner. For example, the steel sheet can be subjected to blanking to form a blank having one or more openings, and then to beading to form a bead surrounding each opening and optionally to folding to form a folded end. Normally, such a beaded blank is assembled with one or more beaded or non-beaded blanks by stacking to fabricate an engine gasket. The surface of the steel sheet except for the beaded area may be coated with a rubber to improve the sealing performance of the gasket, particularly against cooling water.

EXAMPLE

Stainless steels having the compositions shown in Table 2 were prepared by melting in a 10 kg vacuum melting furnace, and they were subjected sequentially to hot rolling, annealing, descaling by pickling, and finally cold-rolling to give a steel sheet having a thickness of 0.2 mm. Each resulting cold rolled steel sheet was heated at a temperature in the range of from 750° C. to 1050° C. for 10 seconds and then quenched by air cooling.

The quenched steel sheet was then tested for Vickers hardness (Hv) of the steel and of the martensitic phases and for martensite fraction in the manner described in the above, and for corrosion resistance in a salt spray test (JIS Z-2371).

Five rectangular test pieces cut out of each quenched steel sheet were deformed by beading on a mold press to form a straight bead having the cross-sectional shape shown in FIG. 2, and they were visually observed to determine if fracture of the sheet occurred in the deformed area.

The test results are also given in Table 2, in which the results of fracture are expressed as the number of fractured test pieces among the five pieces tested. The results of corrosion resistance are expressed as a rating from 0 (worst) to 10 (best) according to the JIS specification.

TABLE 2

| | Chemical Composition (wt %)[1] | | | | | | | Quenched from Heat- | Martensite Fraction | Hard-ness (Hv) | | Number of Fractured | Corrosion Resistance | |
|---|---|---|---|---|---|---|---|---|---|---|---|---|---|---|
| Mark | C | N | C + N | Si | Mn | Cr | Ni | ing at | (Vol %) | Steel | Mar[2] | Samples/5 | (rating) | Remarks |
| A1 | 0.10 | 0.02 | 0.12 | 0.10 | 0.13 | 12.2 | 0.12 | 800° C. | 7.5 | 156 | 302 | 0/5 | 6 | Compar. |
| A2 | " | " | " | " | " | " | " | 850° C. | 45.1 | 307 | 486 | 0/5 | 8 | Invent |
| A3 | " | " | " | " | " | " | " | 900° C. | 53.1 | 370 | 512 | 0/5 | 8 | Invent |
| A4 | " | " | " | " | " | " | " | 950° C. | 56.4 | 403 | 535 | 0/5 | 8 | Invent. |
| A5 | " | " | " | " | " | " | " | 1000° C. | 58.8 | 425 | 548 | 0/5 | 8 | Invent. |
| A7 | " | " | " | " | " | " | " | 1100° C. | 81.4 | 482 | 577 | 0/5 | 8 | Compar. |
| B1 | 0.13 | 0.08 | 0.19 | 0.29 | 0.43 | 13.0 | 0.29 | 800° C. | 26.0 | 243 | 491 | 0/5 | 6 | Compar. |
| B2 | " | " | " | " | " | " | " | 850° C. | 58.7 | 417 | 576 | 0/5 | 8 | Invent. |
| B3 | " | " | " | " | " | " | " | 900° C. | 69.4 | 430 | 551 | 0/5 | 8 | Invent. |
| B4 | " | " | " | " | " | " | " | 950° C. | 74.5 | 483 | 568 | 0/5 | 8 | Invent |
| B5 | " | " | " | " | " | " | " | 1000° C. | 78.7 | 487 | 583 | 1/5 | 8 | Invent. |
| B6 | " | " | " | " | " | " | " | 1050° C. | 82.5 | 523 | 602 | 2/5 | 8 | Compar. |
| C4 | 0.3 | 0.02 | 0.05 | 0.32 | 0.39 | 13.1 | 0.30 | 950° C. | 3.4 | 158 | 243 | 0/5 | 8 | Compar. |
| D4 | 0.30 | 0.12 | 0.42 | 0.30 | 0.42 | 13.4 | 0.28 | 950° C. | 98.2 | 625 | 634 | 5/5 | 8 | Compar. |
| E4 | 0.15 | 0.04 | 0.19 | 0.65 | 0.42 | 12.9 | 0.27 | 950° C. | 76.4 | 541 | 614 | 3/5 | 8 | Compar. |
| F4 | 0.16 | 0.05 | 0.21 | 0.31 | 0.85 | 13.5 | 0.24 | 950° C. | 98.8 | 565 | 570 | 4/5 | 8 | Compar. |
| G4 | 0.15 | 0.01 | 0.22 | 0.80 | 0.33 | 18.1 | 0.25 | 950° C. | 93.1 | 557 | 587 | 4/5 | 8 | Compar. |
| H4 | 0.13 | 0.05 | 0.18 | 0.29 | 0.32 | 13.2 | 0.78 | 950° C. | 99.5 | 573 | 575 | 4/5 | 8 | Compar. |

[1]Balance: Fe and inevitable impurities; [2]Martensite

As can be seen from Table 2, the steel sheets according to the present invention (A2 to A5 and B2 to B5) exhibited a high hardness and good corrosion resistance with minimized or no occurrence of fracture by beading.

In contrast, those steels comprising more than 90% martensite and having a hardness of higher than Hv 500(D4, F4, G4, and H4) frequently resulted in fracture by beading. Such a fracture occurred also with a steel having a hardness greater than Hv 500 although its martensite fraction was not greater than 80% (E4), and with a steel which had been heated at a temperature above 1000° C. for quenching (A7 and B6). Those steels which had been heated at a temperature below 850° C. for quenching (A1 and B1) could not produce a desired hardness of at least Hv 300 by quenching and also showed a deteriorated corrosion resistance.

While the invention has been described in some detail by way of illustration and example, the invention is not restricted to the specific embodiments set forth, It should be understood by those skilled in the art that numerous variations and modifications may be made to the invention without departing from the spirit or scope of the invention as broadly described.

What is claimed is:

1. A gasket made from a stainless steel and having at least one bead for sealing, the stainless steel having a chemical composition comprising on a weight basis:

C+N: 0.1%–0.3%,

Si: not greater than 0.5%,

Mn: not greater than 0.7%,

Cr: 10%–17%, and

Ni: 0–0.6%, the steel having a structure consisting essentially of as-quenched from 40% to 80% by volume of martensite, the balance being ferrite, and a Vickers hardness in the range of from 300 to 500.

2. The gasket according to claim 1 wherein the chemical composition of the stainless steel consists essentially, on a weight basis, of:

C+N: 0.1%–0.3%,

Si: not greater than 0.5%,

Mn: not greater than 0.7%,

Cr: 10%–17%,

Ni: 0–0.6%, and one or more elements selected from the group consisting of Nb, V and Ti: 0 to 2.0% in total, the balance being iron and inevitable impurities.

3. The gasket according to claim 1 wherein the chemical composition has a carbon content in the range of from 0.10% to 0.20%.

4. The gasket according to claim 1 wherein the chemical composition has a nitrogen content in the range of from 0.02% to 0.09%.

5. The gasket according to claim 1 wherein the chemical composition has an Si content in the range of from 0.2% to 0.4%.

6. The gasket according to claim 1 wherein the chemical composition has an Mn content in the range of from 0.25% to 0.5%.

7. The gasket according to claim 1 wherein the chemical composition has a Cr content in the range of from 12% to 15%.

8. The gasket according to claim 1 wherein the chemical composition has an Ni content in the range of from 0% to 0.5%.

9. The gasket according to claim 1 wherein the martensite of the steel has a Vickers hardness in the range of from 300 to 600.

10. A metal gasket made from a stainless steel and having at least one bead for sealing, the stainless steel having a structure consisting essentially of from 40% to 80% by volume of as-quenched martensite, the balance being ferrite, and a Vickers hardness in the range of from 300 to 500.

11. A metal gasket made from a stainless steel and having at least one bead for sealing, said stainless steel having an as-quenched martensitic-ferritic duplex-phase structure.

* * * * *

UNITED STATES PATENT AND TRADEMARK OFFICE

CERTIFICATE OF CORRECTION

PATENT NO. : 6,277,215 B1
DATED : August 21, 2001
INVENTOR(S) : Kazuhiko Adachi et al.

It is certified that error appears in the above-identified patent and that said Letters Patent is hereby corrected as shown below:

Title page,
The title page is corrected to read:

-- [54] STAINLESS STEEL FOR GASKETS AND PRODUCTION THEREOF --

Signed and Sealed this

Twenty-fifth Day of June, 2002

*Attest:*

*Attesting Officer*

JAMES E. ROGAN
*Director of the United States Patent and Trademark Office*